US009299325B1

(12) United States Patent
Brickwell

(10) Patent No.: US 9,299,325 B1
(45) Date of Patent: Mar. 29, 2016

(54) GUITAR VIBRATO STABILIZING DEVICE

(71) Applicant: William Brickwell, Anchorage, AK (US)

(72) Inventor: William Brickwell, Anchorage, AK (US)

( * ) Notice: Subject to any disclaimer, the term of this patent is extended or adjusted under 35 U.S.C. 154(b) by 0 days.

(21) Appl. No.: 14/600,379

(22) Filed: Jan. 20, 2015

(51) Int. Cl.

| | |
|---|---|
| ***G10D 3/14*** | (2006.01) |
| ***G10D 1/08*** | (2006.01) |
| ***G10D 3/00*** | (2006.01) |
| ***G10D 3/04*** | (2006.01) |

(52) U.S. Cl.
CPC ..... *G10D 3/146* (2013.01); *G10D 3/00* (2013.01); *G10D 3/04* (2013.01); *G10D 3/14* (2013.01)

(58) Field of Classification Search
CPC ..... G10D 3/00; G10D 3/04; G10D 3/14; G10D 3/146
USPC ..... 84/313, 267, 297 R, 312 R
See application file for complete search history.

(56) References Cited

U.S. PATENT DOCUMENTS

| | | | | | |
|---|---|---|---|---|---|
| 2,152,783 | A * | 4/1939 | Beauchamp | G10D 1/08 | 84/1 |
| D170,109 | S * | 8/1953 | Bigsby | 84/313 | |
| 2,781,685 | A * | 2/1957 | White | G10D 3/146 | 84/312 R |
| 3,124,991 | A * | 3/1964 | Costen | G10D 3/146 | 84/267 |
| 3,237,502 | A * | 3/1966 | Moseley | G10D 3/14 | 224/264 |
| 3,252,368 | A * | 5/1966 | William | G10D 3/146 | 84/313 |
| 3,422,509 | A * | 1/1969 | Porter | G10D 3/146 | 84/313 |
| 3,437,001 | A * | 4/1969 | Kraft | G10D 3/146 | 84/312 R |
| 3,457,821 | A * | 7/1969 | Huis | G10D 3/146 | 84/313 |
| 4,487,100 | A * | 12/1984 | Storey | G10D 3/146 | 84/299 |
| D278,067 | S * | 3/1985 | Bowen | 84/313 | |
| 4,512,232 | A * | 4/1985 | Schaller | G10D 3/146 | 84/267 |
| 4,648,304 | A * | 3/1987 | Hoshino | G10D 3/146 | 84/297 S |
| 5,747,713 | A * | 5/1998 | Clement | G10D 3/146 | 84/313 |
| 6,420,639 | B1 * | 7/2002 | Sherlock | G10D 3/146 | 84/298 |
| 7,459,619 | B2 * | 12/2008 | Gawenda | G10D 3/146 | 84/313 |
| 7,709,713 | B1 * | 5/2010 | Pearce | G10D 3/146 | 84/299 |
| 8,163,987 | B1 * | 4/2012 | Dennis | G10D 3/12 | 84/297 R |
| 8,678,659 | B2 * | 3/2014 | Miller | G10D 3/146 | 384/313 |
| 8,766,069 | B2 * | 7/2014 | Bisheimer | G10D 3/00 | 84/267 |
| 8,940,986 | B1 * | 1/2015 | Edwards | G10D 3/14 | 84/267 |
| 9,142,197 | B2 * | 9/2015 | Oldfield | G10D 1/085 | |
| 2007/0240554 | A1 * | 10/2007 | Hany | G10D 3/14 | 84/312 R |
| 2008/0141843 | A1 * | 6/2008 | Thompson | G10D 3/146 | 84/313 |
| 2008/0229900 | A1 * | 9/2008 | Steinberger | G10D 3/146 | 84/313 |
| 2010/0011936 | A1 * | 1/2010 | Dennis | G10D 3/146 | 84/313 |
| 2010/0064877 | A1 * | 3/2010 | Deck | G10D 3/146 | 84/313 |

(Continued)

*Primary Examiner* — David Warren
*Assistant Examiner* — Christina Schreiber
(74) *Attorney, Agent, or Firm* — Michael J. Tavella

(57) ABSTRACT

An improved roller assembly that, when installed on a BIGSBY vibrato system, causes the roller to be raised, which reduces the angle of the strings. This reduces the tension on the strings, which improves the performance of the device and reduces or eliminates the instability in tuning. Two versions of the device are disclosed that can be used with both BIGSBY and BIGSBY LICENSE model vibratos.

5 Claims, 9 Drawing Sheets

(56) References Cited

U.S. PATENT DOCUMENTS

2010/0257991 A1* 10/2010 Williams ..... G10D 3/146 84/313
2010/0282042 A1* 11/2010 Dennis ..... G10D 3/146 84/313
2010/0294110 A1* 11/2010 Towner ..... G10D 3/146 84/313
2011/0036228 A1* 2/2011 Deck ..... G10D 3/146 84/313
2011/0126690 A1* 6/2011 Hendricks ..... G10D 3/146 84/307
2012/0234155 A1* 9/2012 Finkle ..... G10D 3/146 84/313
2013/0255468 A1* 10/2013 Miller ..... G10D 3/146 84/313
2014/0123830 A1* 5/2014 Finkle ..... G10D 3/146 84/313
2014/0230628 A1* 8/2014 Hunter ..... G10D 3/006 84/297 R
2015/0068386 A1* 3/2015 Oldfield ..... G10D 3/146 84/403

* cited by examiner

GUITAR VIBRATO STABILIZING DEVICE

CROSS REFERENCE TO RELATED APPLICATIONS

Not Applicable

STATEMENT REGARDING FEDERALLY SPONSORED RESEARCH AND DEVELOPMENT

Not Applicable

BACKGROUND OF THE INVENTION

1. Field of the Invention

This invention relates to guitar vibrato devices and particularly to guitar vibrato stabilizing devices.

2. Description of the Prior Art

Modern electric and modified acoustic guitars often use a vibrato device (often mistakenly called a "tremolo" "tremolo bar") for enhanced musical performance. Although many such devices are used, the vibratos predominant used are produced by the Bigsby company as the BIGSBY vibrato tailpiece. Popular models include the "B5", "B7" and "B12 and" "BIGSBY LICENSED" Brand models "B50", "B70" and "B700" vibrato systems. The difference between them being that BIGSBY LICENSED devices are produced overseas.

As shown in FIGS. 1-6 (prior art), the Bigsby models "B5", "B7" and "B12" have the same basic components. The difference between them has to do with the type of guitar on which the vibrato is installed. A BIGSBY model "B5" is designed for flattop, solid body guitars. A model "B7" is designed for thin electric guitars and has more downward pressure and the model "B12" is designed for large acoustic and arch-topped guitars. FIGS. 1 and 2 show a BIGSBY type "B5" model without strings, as prior art. This device has a frame 100 that has a formed tailpiece 101 that is used to secure the ends of the strings, as discussed below. At the front of the frame 100 is a roller 102 that is used to carry the strings and allows the strings to move when the vibrato is being used. A handle 103 (commonly called a "whammy bar") is attached to a spring 104 that is positioned under an extension 105 as shown. Note that the extension is rotatably installed on the frame.

FIGS. 3 and 4 show a BIGSBY type model "B7" or "B12 model without strings, as prior art. These models are similar to the "B5" in that they have a frame 110 that has a formed tailpiece 111 that is used to secure the ends of the strings. Note that for the "B7" or "B12 models, the frame 110 extends rearward as shown. At the front of the frame 110 is a roller 112 that is used to carry the strings and allows the strings to move when the vibrato is being used. A handle 113 (commonly called a "whammy bar") is attached to a spring 114 that is positioned under an extension 115 as shown. Note that the extension is rotatably installed on the frame.

FIG. 5 is a side view of a BIGSBY model "B7" or "B12" with strings, as prior art, showing a reduced angle of the strings passing under the front roller. Here, the strings 120 pass over a bridge 121 that has a saddle 122 on it. The saddle 122 has a number of grooves formed on it to receive the strings, which helps to hold them in place and anchors them to the bridge. The bridge is placed on to of the guitar body 123. Note that the guitar neck (not shown is to the left of the figure). Note too that the strings pass under the front roller 112 and then up and over the tailpiece 111. The roller 112 provides a certain amount of required downward string tension on the bridge 122 of guitar to keep the strings 120 from falling out of the grooves of bridge saddle 122 while playing. Normally, when playing the strings remain in a fixed position, axially with respect to the longitudinal axis of the guitar. When the whammy bar is depressed and released (the spring 114 pushed the handle back upwards), the strings are pushed and pulled slightly axially, as indicated by the arrows. This produces the vibrato sounds that the device is designed to achieve.

FIG. 6 is a side view of a BIGSBY model "B7" or "B12" with strings, as prior art, showing an increased angle of the strings passing under the front roller because of the closer bridge placement. In this figure, the bridge 122 is positioned near the front of the frame 110 (within 2 inches). Note the angle made by the strings 120 passing over the saddle 122 and under the roller 112. The extreme angle created by the strings passing under roller 112 creates too much tension on the roller 112 causing impediment to optimum rolling as strings 120 move during typical vibrato operation, thus causing instability in tuning.

BRIEF DESCRIPTION OF THE INVENTION

The instant invention overcomes these difficulties. It is an improved roller assembly that, when installed on a BIGSBY vibrato system, causes the roller to be raised, which reduces the angle of the strings. This reduces the tension on the strings, which improves the performance of the device and reduces or eliminates the instability in tuning.

DETAILED DESCRIPTION OF THE INVENTION

Figure 7:
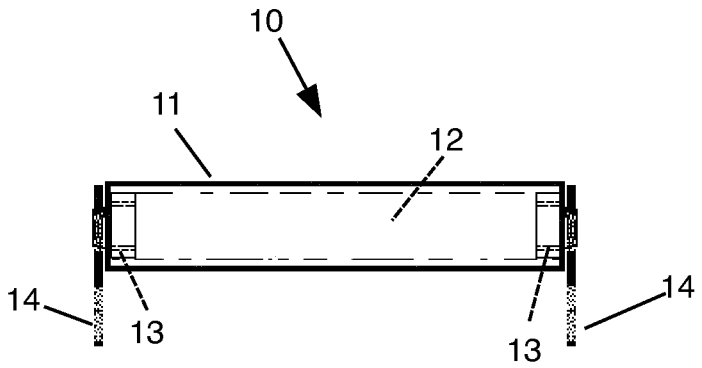
FIG. 7 is a front view of the roller system of the instant invention for the BIGSBY type "B5", "B7" or "B12" model.
Figure 8:
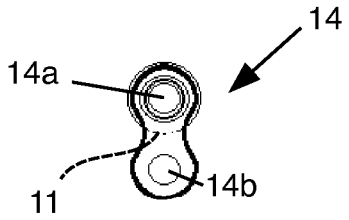
FIG. 8 is a right side view of the roller system of the instant invention for the BIGSBY type "B5", "B7" or "B12" model.
Figure 9:
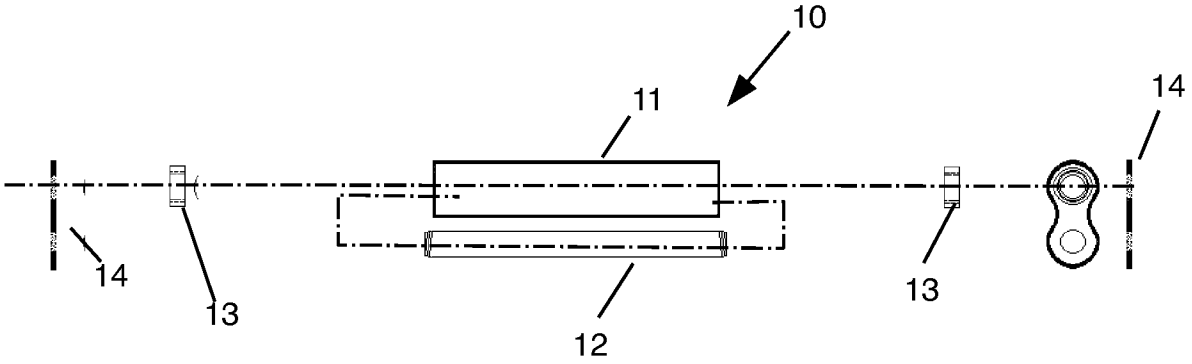
FIG. 9 is an exploded view of the components of the roller system of the instant invention for a BIGSBY type "B5", "B7" OR "B12" models.

Referring now to FIG. 7, a front view of the roller system of the instant invention for the BIGSBY type "B5", "B7" or "B12" models. The invention 10 attaches to the existing roller axle frame 100 on the B5, and 110 on the B7 & B12 models) once the existing roller 112 is removed. Referring now to FIGS. 7, 8 and 9, the invention 10 is a pair of cylinders. The first is a roller 11 and the second is an axle 12 that sits within the roller 11. Sealed bearings 13 (see FIG. 9) are positioned between two end posts 14 as shown. FIG. 8 shows and end view of the device. Here, one of the end posts 14 is shown. Although the end post here is shown having a figure "8" shape, it is not important to the operation of the device. The important factor is that there are two holes formed on the end post 14. The hole at the top 14*a* is used to secure the axle 12 and its components to the end post. This is done with threads, as described below. The hole 14*b*, located in the lower portion of the end post 14, is used to connect the new roller device to the axle frame of the vibrato device. This hole is threaded to accept an 8-32×½ inch screw (not shown). This screw is used to attach the device to the existing vibrato, as discussed below.

The relationship of the two holes is important in that the spacing defines the amount of height that the roller 11 of the device is raised, which produces less tension. With less tension on the new roller, tuning stability increases. The unit is designed so that the axle 12 allows the roller 11 to move on the bearings. FIG. 9 is an exploded view of the invention 10. Here, the roller 11 is shown with the axle 12.

In the preferred embodiment, the axle 12 is a cylinder ¼ inch in diameter and is 56.62 mm in length. The ends 12*a* of the axle have ¼-28 NF threads formed on them. The roller 11 has an inside diameter of ⅜ inch and an outside diameter of 7/16 inches. The roller 11 has a length of 53.10 mm. The sealed bearings 13 have and inside diameter of ¼ inch, an outside diameter of ⅜ inch and a thickness of ⅛ inch. The end post, as noted above, has a top hole 14*a* that has a ¼-28 NF tapered thread to receive the axle 12. The end post has a height of 18.45 mm and is 1.35 mm thick. The bottom hole 14*b* is 13/64 inches in diameter, and as noted, is threaded with 8-32 NF tapered threads. When assembled, the device has an overall length of 56 mm and an overall height of 19.45 mm.

The device is assembled by first inserting the axle 12 into the roller 11. Pressing the sealed bearings 13 into each end of the roller such that the threaded ends of the axle 12 extend out from the roller. Then each end post is screwed onto the ends of the axle 11 until the unit is secure. Then, the device can be installed into the vibrato device, as discussed below.

Figure 6:
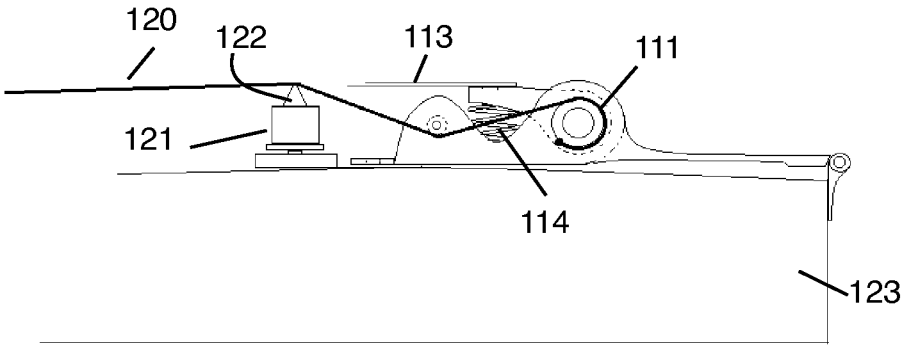
Figure 6 Prior Art
FIG. 6 is a side view of a BIGSBY model "B7" or "B12" with strings, as prior art, showing an increased angle of the strings passing under the front roller because of the closer bridge placement.
Figure 10:
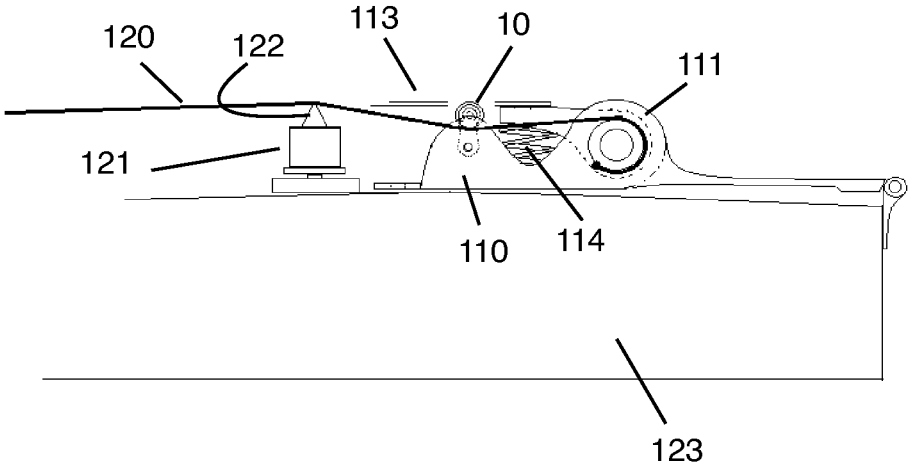
FIG. 10 is a side view of a BIGSBY type "B5", "B7" or B12 model with the roller system of the instant invention installed, showing the improved string angle with a closely positioned bridge.

FIG. 10 is a side view of a BIGSBY type "B7" of "B12", model with the roller system of the instant invention installed, showing the improved string angle with a closely positioned bridge. In this figure, the vibrato device 100 has the same components as described above, including the tailpiece 110, the whammy bar 103, the spring 104, the bridge 121 and the saddle 122. Unlike the prior art model, this figure shows that the roller 10 is the instant invention. Note how the raised position of the roller 10 makes the angle of the strings 120 less severe, as compared to that of FIG. 6. This reduced angle helps keep the strings in tune making playing a lot better.

The improved roller system is modified to be compatible with the BIGSBY LICENSED" brand model "B50", "B70" or "B700 models, as discussed below.

Figure 11:
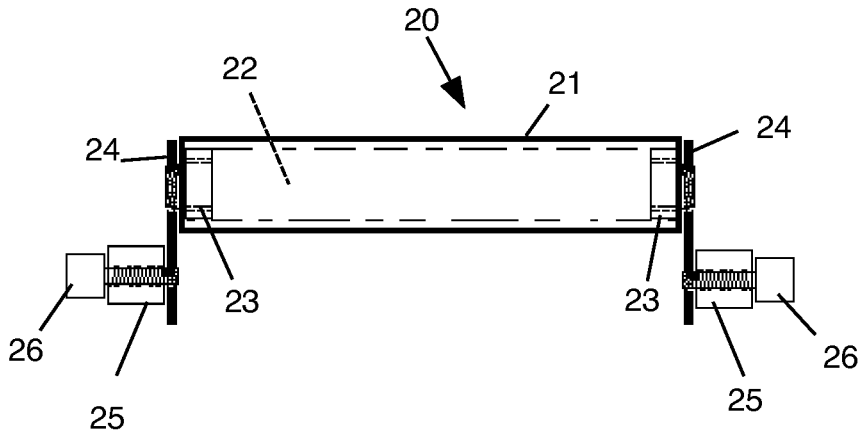
FIG. 11 is a front view of the roller system of the instant invention for use with a BIGSBY LICENSED" brand model "B50", "B70" or "B700 model.
Figure 12:
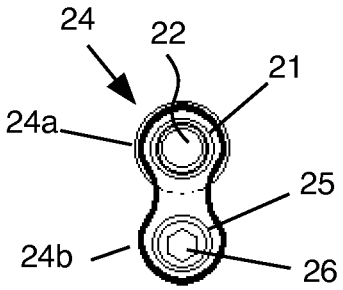
FIG. 12 is a right side view of the roller system of the instant invention for use with a BIGSBY LICENSED" brand model "B50", "B70" or "B700 model.
Figure 13:
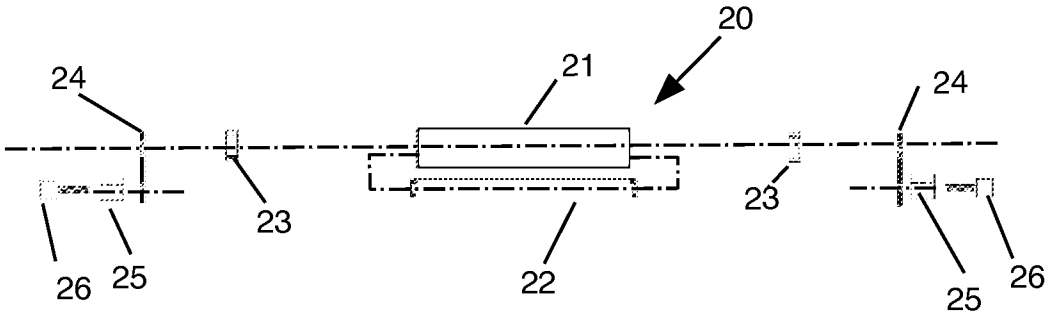
FIG. 13 is an exploded view of the components of the roller system of the instant invention for a BIGSBY LICENSED" brand model "B50", "B70" or "B700 model.

Referring now to FIGS. 11, 12, and 13, details of the roller system of the instant invention for use with a BIGSBY LICENSED" brand model "B50", "B70" or "B700 models are shown. FIG. 11 is a front view of the assembled (but not installed) device 20. As before, this version has a roller 21, an axle 22, sealed bearings 23 and end posts 24. In addition to those components, nylon bushings 25 and hex key screws 26 are used to install the device into the existing vibrato body, as discussed below.

FIG. 12 is a right side view of the roller system of the instant invention for use with a BIGSBY LICENSED" brand model "B50", "B70" or "B700 model. In this figure, the end post 24 is shown. As before, the end post 24 has a top hole 24*a* that has tapered threads to accept the axle 22. The lower hole 24*b* is also threaded to accept the hex screw 26.

Figure 1:
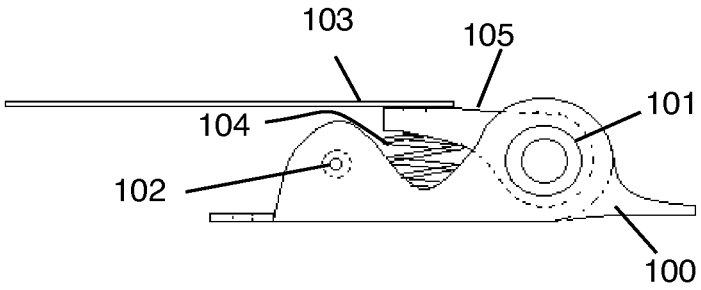
Figure 1 Prior Art
FIG. 1 is a side view of a BIGSBY type "B5" model without strings, as prior art.
Figure 2:
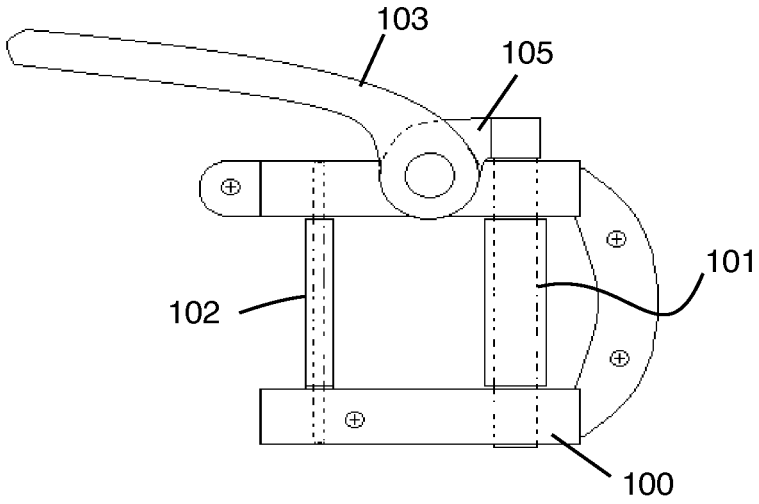
Figure 2 Prior Art
FIG. 2 is a top view of a BIGSBY type "B5" model without strings, as prior art.
Figure 3:
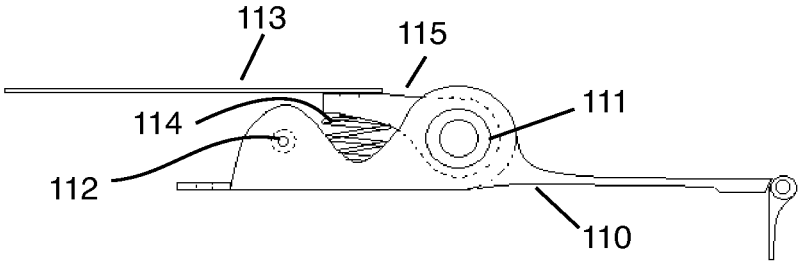
Figure 3 Prior Art
FIG. 3 is a side view of a BIGSBY model "B7" or "B12" without strings, as prior art.
Figure 4:
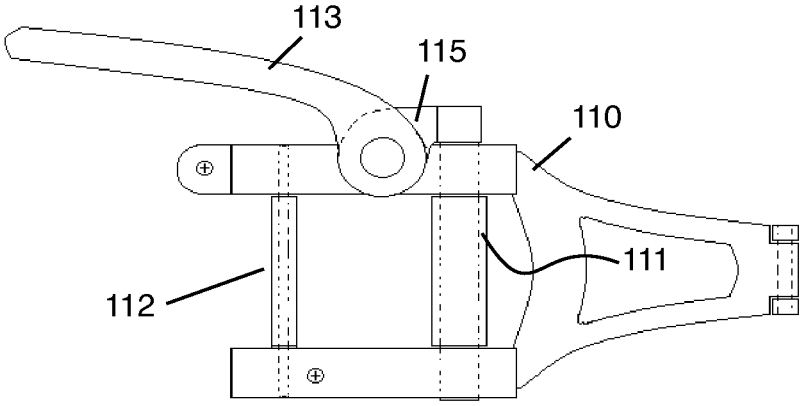
Figure 4 Prior Art
FIG. 4 is a top view of a BIGSBY model "B7" or "B12" without strings, as prior art.
Figure 5:
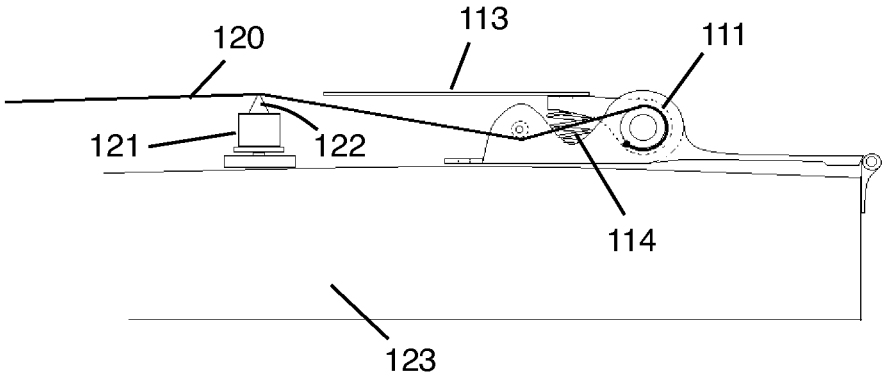
Figure 5 Prior Art
FIG. 5 is a side view of a BIGSBY model "B7" or "B12" with strings, as prior art, showing a reduced angle of the strings passing under the front roller.
Figure 14:
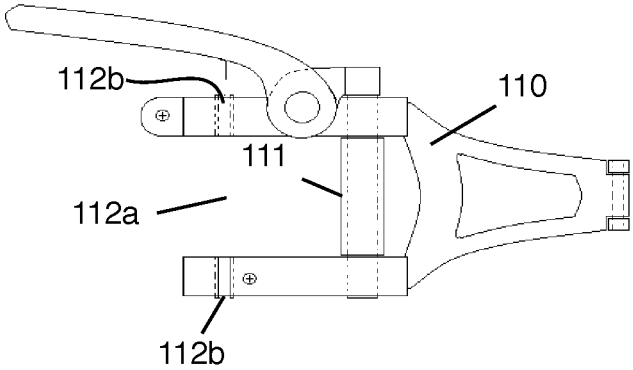
FIG. 14 is a detail view of a vibrato with the original roller removed, ready for the installation of the roller system of the instant invention.

FIG. 13 is an exploded view of the components of the roller system of the instant invention for a BIGSBY LICENSED" brand model "B50", "B70" or "B700 model. Note that in the preferred embodiment, the roller 21 I 55.10 mm long and has an inside diameter of ⅜ inch and an outside diameter of 7/16 inch. The axle 22 has a length of 58.62 mm and a diameter of ¼ inch with ¼-28 NF threads cut on both ends. The sealed bearings 23 have an inside diameter if 1.4 inch and an outside diameter of ⅜ inch and a width off ⅛ inch. Each end post 24 is 1.25 mm thick and has a height if 17.10 mm. The top hole 24*a* has ¼-28 NF tapered threads. The bottom hole 14*b* has 8-32 NC tapered threads. Also in the preferred embodiment, the nylon bushings 25 are ⅜ inch×3/316 in ×¼ inch nylon and hex key screws 26 are 8-32 NC×½ inch 9/64 inch stainless steel hex key screws. When assembled, the roller and end posts have an overall length of 58 mm and a height of 17.10 mm. The nylon bushings and screws extend beyond these dimensions, FIG. 14 is a detail view of a vibrato device of the BIGSBY LICENSED" brand model 110, as shown in FIG. 4 with the original roller 112 removed, ready for the installation of the roller system of the instant invention. Note the opening 112*a* and the open portions 112*b* of the vibrato arms that are ready to receive the device 20.

Figure 15:
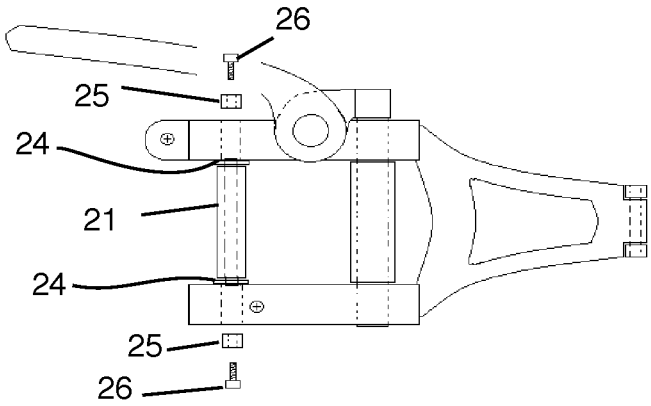
FIG. 15 is a detail view of the roller system of the instant invention being installed.

FIG. 15 is a detail view of the roller system of the instant invention being installed in the vibrato of FIG. 14. First, the existing axle, roller and nylon bushings must be removed. Note that in this top view, the roller 21 is shown in the space 112*a* (see FIG. 14). Note the end plates 24 are positioned as shown. Note too that the lower holes 24*b* (not visible) are aligned with the open portions 112*b*. Note too the bushings 25 and the hex key screws 26, which are positioned on the outside of the vibrato device. The bushings are pushed into the holes 112*b* and the screws then engage the holes 24*b* in the end plates to secure the device in place.

Similarly, for the installation of the device 10 into a BIGSBY type "B5", "B7" or "B12" model, the device is positioned between the arms of the vibrato device and screws are used to attach the device using the 8-32×½ inch screws mentioned above.

One feature of the new roller is that when it attached to existing roller axle location the entire device has the ability to pivot during typical tremolo operation. This further reduces string movement and any restriction at new roller location, which adds additional tuning stability.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

I claim:

1. A raised roller system for use with a vibrato device having a tension roller comprising:

a) a roller, being hollow and having a first end and a second end;

b) an axle positioned inside of said roller and having a first end and a second end, each end having a set of threads formed thereon;

c) a first sealed bearing being positioned in said first end of said roller such that the first end of said axle passes through said first sealed bearing;

d) a second sealed bearing being positioned in said second end of said roller such that the second end of said axle passes through said second sealed bearing;

e) a first end plate having a top portion and a bottom portion, and further wherein the top portion having a threaded hole herein, to receive the first end of said axle, which is threadably secured into said first end plate, said first end plate further having a hole formed in said bottom portion of said first end plate; and f) a second end plate having a top portion and a bottom portion, and further wherein the top portion having a threaded hole herein, to receive the second end of said axle, which is threadably secured into said second end plate, said second end plate further having a hole formed in said bottom portion of said second end plate.

2. The raised roller system of claim 1 wherein the first and second end plates have a figure "8" shape.

3. A raised roller system for use with a vibrato device having a tension roller comprising:

a) a roller, being hollow and having a first end and a second end;

b) an axle positioned inside of said roller and having a first end and a second end, each end having a set of threads formed thereon;

c) a first sealed bearing being positioned in said first end of said roller such that the first end of said axle passes through said first sealed bearing;

d) a second sealed bearing being positioned in said second end of said roller such that the second end of said axle passes through said second sealed bearing;

e) a first end plate having a top portion and a bottom portion, and further wherein the top portion having a threaded hole herein, to receive the first end of said axle, which is threadably secured into said first end plate, said first end plate further having a threaded hole formed in said bottom portion of said first end plate;

f) a second end plate having a top portion and a bottom portion, and further wherein the top portion having a threaded hole herein, to receive the second end of said axle, which is threadably secured into said second end plate, said second end plate further having a threaded hole formed in said bottom portion of said second end plate;

g) a first nylon bushing, installed in a first mounting arm of said vibrato device;

h) a first screw, installed in said first mounting arm of said vibrato device such that said first screw passes through said first nylon bushing and is threadably engaged with the threaded hole in the bottom portion of said first end plate;

i) a second nylon bushing, installed in a second mounting arm of said vibrato device;

j) a second screw, installed in said second mounting arm of said vibrato device such that said second screw passes through said second nylon bushing and is threadably engaged with the threaded hole in the bottom portion of said second end plate.

4. The raised roller system of claim 3 wherein the first and second end plates have a figure "8" shape.

5. The raised roller system of claim 3 wherein the first and second screws are hex head stainless steel screws.

* * * * *